US008210253B2

(12) United States Patent
Head

(10) Patent No.: US 8,210,253 B2
(45) Date of Patent: Jul. 3, 2012

(54) OIL WELL PUMP

(75) Inventor: Philip Head, Egham (GB)

(73) Assignee: Artificial Lift Company Limited, Engham, Surrey (GB)

( * ) Notice: Subject to any disclaimer, the term of this patent is extended or adjusted under 35 U.S.C. 154(b) by 290 days.

(21) Appl. No.: 12/441,450

(22) PCT Filed: Sep. 17, 2007

(86) PCT No.: PCT/GB2007/050553

§ 371 (c)(1),
(2), (4) Date: Oct. 16, 2009

(87) PCT Pub. No.: WO2008/032126

PCT Pub. Date: Mar. 20, 2008

(65) Prior Publication Data

US 2010/0044026 A1 Feb. 25, 2010

(30) Foreign Application Priority Data

Sep. 15, 2006 (GB) ..... 0618143.2
Jan. 24, 2007 (GB) ..... 0701337.8

(51) Int. Cl.
*F04B 1/12* (2006.01)

(52) U.S. Cl. ..... 166/105; 417/269

(58) Field of Classification Search ..... 166/105; 417/254, 261, 267, 269; 92/71
See application file for complete search history.

(56) References Cited

U.S. PATENT DOCUMENTS 1,430,602 A * 10/1922 Sykora ..... 417/517
1,521,364 A * 12/1924 Froelich ..... 417/269
1,554,628 A * 9/1925 Froelich ..... 417/269
1,649,196 A * 11/1927 Sandage ..... 417/259
2,124,800 A * 7/1938 Sykora ..... 91/184
2,291,601 A * 8/1942 Bancroft ..... 417/461
2,312,228 A * 2/1943 Adair ..... 417/269
2,839,008 A * 6/1958 Stansfield et al. ..... 91/502
3,730,145 A * 5/1973 Bennetto ..... 123/235
4,457,367 A * 7/1984 Brandell ..... 166/105
4,756,239 A * 7/1988 Hattori et al. ..... 92/71
2008/0196880 A1 * 8/2008 Head ..... 166/66.4

FOREIGN PATENT DOCUMENTS

DE 19951211 A1 * 4/2001

* cited by examiner

*Primary Examiner* — Jennifer H Gay
*Assistant Examiner* — Blake Michener
(74) *Attorney, Agent, or Firm* — Fay Sharpe LLP

(57) ABSTRACT

A pump system for use in with a downhole pipe string has a pump comprising at least one cylinder with at least one piston inside the cylinder, the movement of the piston causing fluid to be drawn into the pump through a pump inlet before being pushed out through a pump outlet. The pump is housed in a tube having a cammed surface formed by internal wall of the tube, and the piston has a cam follower such that rotation of the piston relative to the tube causes the piston to move relative to the cylinder. Further, a pump system is shown which has two or more such pumps arranged along the downhole pipe string, the pump outlets feeding into a common manifold. The strokes of the piston or pistons of one pump may be out of step with the strokes of the piston or pistons of another pump such that the outlet stream is more uniform.

11 Claims, 3 Drawing Sheets

OIL WELL PUMP

CROSS-REFERENCE TO RELATED APPLICATIONS

This application is a national stage entry of international application number PCT/GB2007/050553, having international filing date Sep. 17, 2007, which was published in English, which claims priority to Great Britain patent application numbers GB 0618143.2, filed Sep. 15, 2006 and GB 0701337.8, filed Jan. 24, 2007, the entireties of which applications are hereby incorporated by reference.

BACKGROUND

Pumps are used in a variety of industries; mainly in the oil industry very long, small diameter pumps are required as the geometry of the well requires that a pump fits within the small diameter of the well bore.

Traditionally, there are two solutions for down hole well pumps, the first is a centrifugal type pump, which generally is very effective, however ideally needs a relatively large diameter and many stages to boost the pressure the 500-1000 psi range which is often required. The second type of pump is a progressive cavity type pump, this is rather like a positive displacement auger in which the fluid is screwed up a helical path within a elastomeric stator forming the pressure seal. The disadvantage with these pumps is that they are not effective at high pressures and are prone to failure due significantly to elastomeric seal failure.

This invention aims to provide a new type of pump suitable for use in down hole oil and gas well applications which does not have these disadvantage.

According to the invention there is provided a multi-stage positive displacement pump comprising at least one piston means 6 disposed for reciprocal movement in a piston chamber 8 said piston means 6 having rollers 4 arranged therewith, said rollers 4 being located in a slot 20 which is formed in a housing 1 and follows a helical path on the internal surface thereof, such that when there is rotational movement between the housing and the pistons the pistons are correspondingly moved in the piston chamber 8, and wherein the piston chamber comprises a fluid inlet and a fluid outlet such that movement of the piston in the piston chamber serves to urge fluid that has entered the piston chamber through the inlet up out through the outlet.

According to another aspect of the present invention, there is provided a pump system having two or more pumps arranged along the downhole pipe string, the pump outlets feeding into a common manifold.

According to another aspect of the present invention, there is provided a pump system having two or more pumps arranged along the downhole pipe string, with one pump outlet feeding into an adjacent pump inlet.

Using pumps to forms a multi stage positive displacement pump which feeds in a parallel manner into a common discharge manifold, or a serial manner, each feeding to the next, and having a flush outside diameter, may advantageously be applied to other types of pumps.

Preferably the fluid to the fluid inlet is drawn from at least one port which is diametrically on the outer part of the pump and the fluid from the fluid outlet is urged into a central bore running through the centre of the pump.

Preferably the pump is arranged to be a modular pump with the potential for multiple stages. Each end of the pump has corresponding connection means to an adjacent pump so that a plurality of pumps can be arranged in series.

Furthermore it is possible and preferable to orientate each stage to phase the discharge and hence make the flow in the common manifold close to uniform.

It is preferable that all pumping surfaces are hard faced and honed to a precision fit to achieve high discharge pressures thus eliminating all additional seal parts.

Preferably the piston means is double acting with a piston chamber 8 at each end such that with for a downward stroke at one end resulting in intake of fluid there is a corresponding up stroke at the other end discharging fluid.

Preferably there are two pistons 6 in the pump module, however another number of pistons may be accommodated per pump module depending on the size of the pump.

Figure 1:
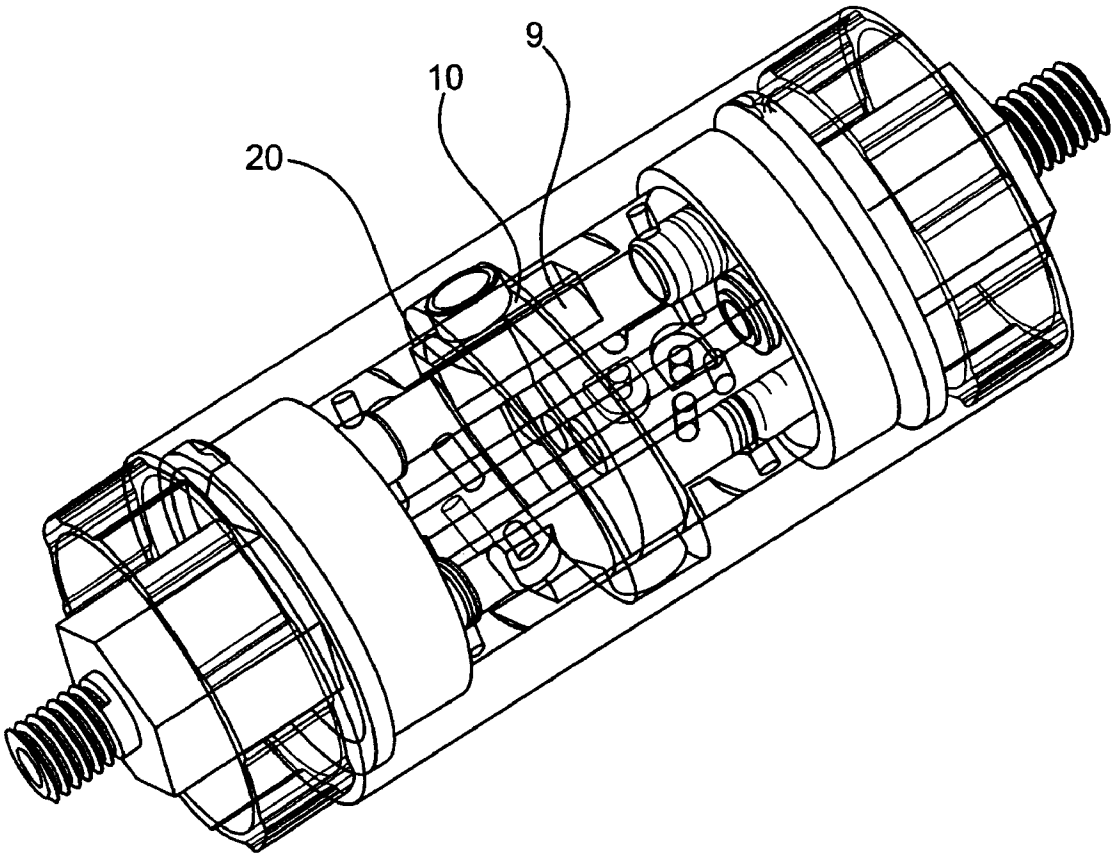
FIG. 1 is a isometric view of the pump assembly with the housing made transparent.
Figure 2:
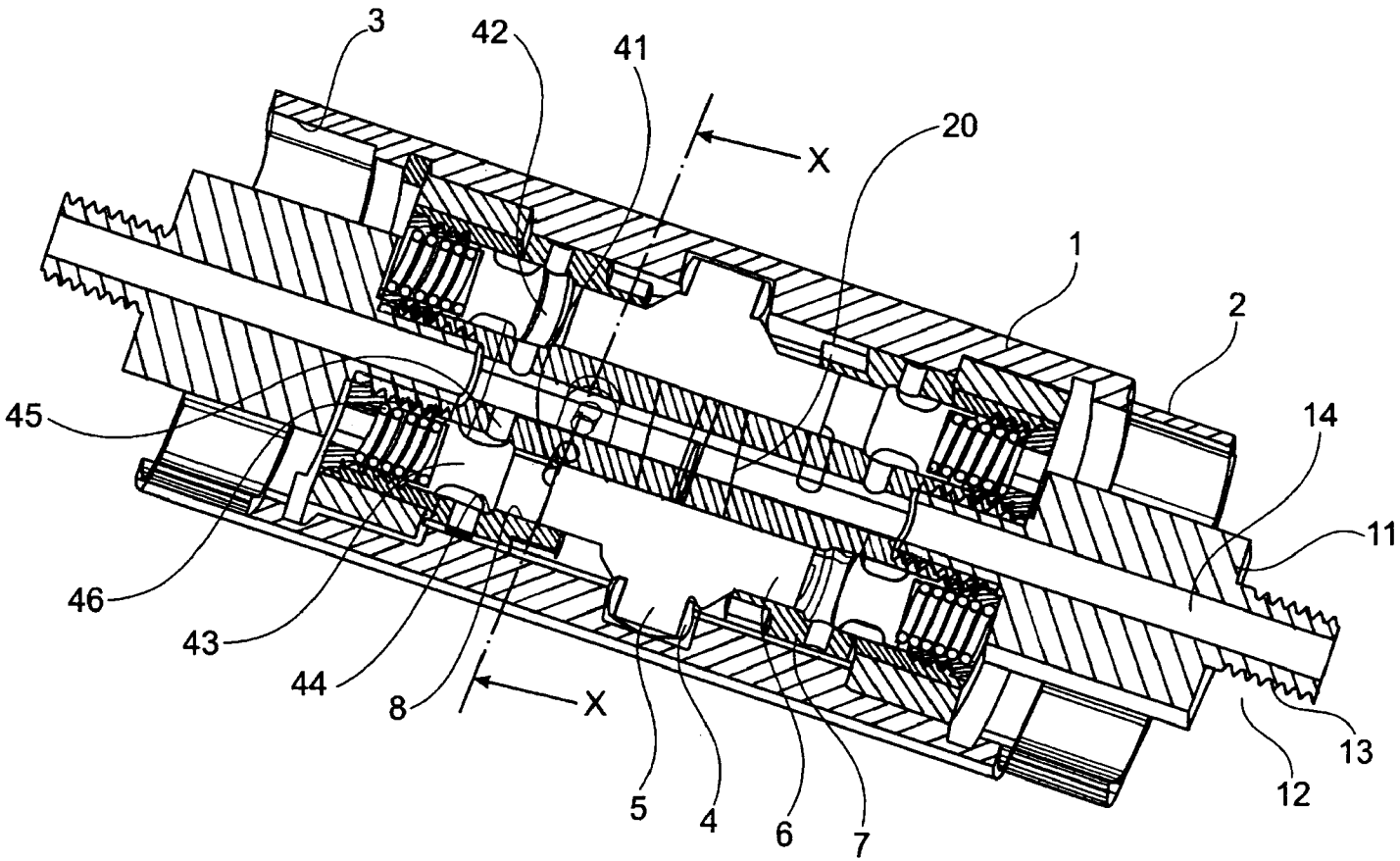
FIG. 2 is a section side view of the pump.
Figure 3:
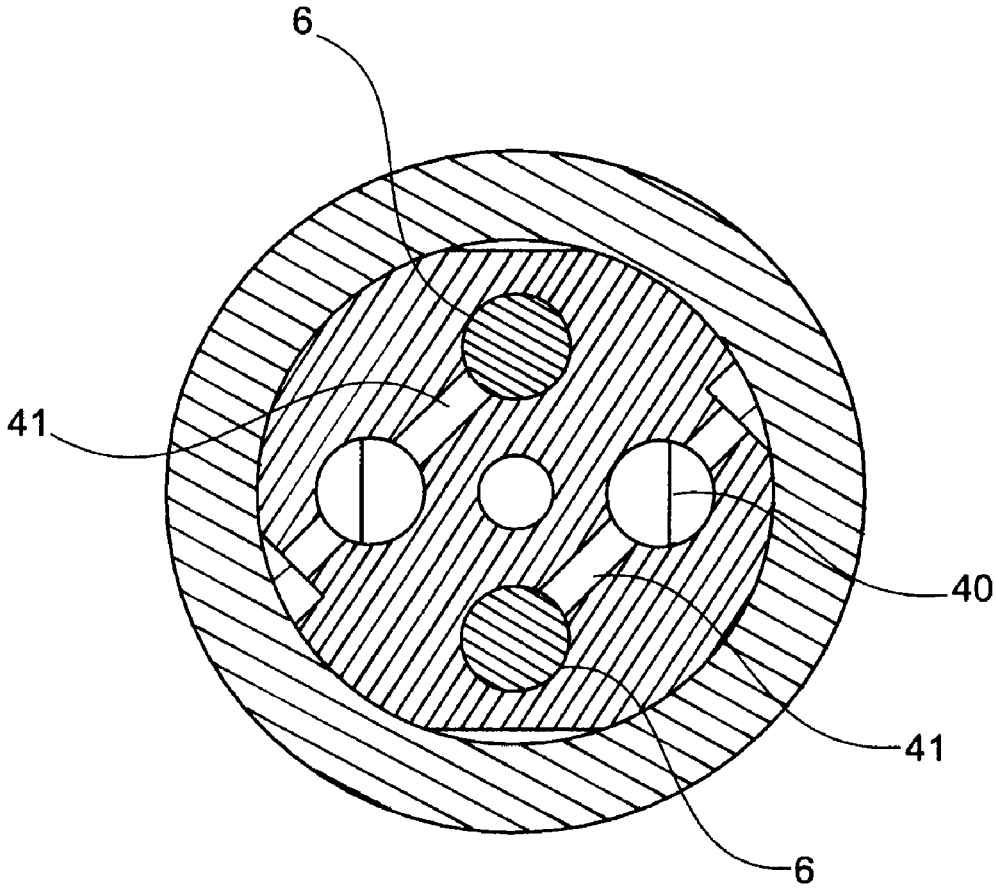
FIG. 3 is a section end view XX of FIG. 2.

Referring to the FIGS. 1 to 3 there is shown a pump housing 1. At each end of the housing 1 there is formed a male and female matching spline 2 and 3 which enables a plurality of housings 1 to be connected together in series.

On the inside surface of the housing 1 is machined a slot 20 which follows an helical path. Rollers 4 supported on roller support buts 5 are located in the slot 20. The support buts 5 are in turn part of a piston 6 such that the piston 6 a follows a piston stroke in the piston bore 8 when the main shaft 11 is rotated relative to the housing 1.

The piston bore 8 is formed by a cylinder block 7. A flank 9 of the piston 6, locates in slots 10 of the cylinder block 7 such that the piston 6 rotates with the main shaft 11. The cylinder block 7 also comprises an inlet port 41 which allows fluid into the piston bore 8 at one end of the stroke of the piston 6 and an outlet port 45 through which fluid is forced outwardly by the action of the piton 6 at the opposite end of the stroke of the piston 6. Thus fluid is drawn into the piston chamber 8 via the inlet port 41 from common galleries 40 on the inlet side of the pump, when the piston 6 is on its downward stroke. At the downward point port 41 is exposed and fluid fills the chamber 8. On the upward stroke, the piston closes the port 41 and energises the fluid in the contained chamber 8. A discharge valve 43 seals the discharge port 45 while seated on valve seat 44 during the downward stroke of the piston 6. Both a spring 46 and discharge manifold pressure keep this valve closed. So the pressure in the piston chamber has to match the discharge manifold pressure before the valve opens. This is particularly relevant if the fluid being pump has entrained gas.

Each piston is double acting on a piston chamber 8 at each end such that with for a downward stroke at one end resulting in intake of fluid there is a corresponding up stroke at the other end discharging fluid.

In the embodiment shown there are two pistons 6 in the pump module, however it will be appreciated that another number of pistons could be accommodated per pump module within the scope of the invention.

The main shaft 11 comprises connecting parts 12 which comprise threaded connections 13 which enable each pump element to be modular and stacked together. Each pump module can be orientated so that the pistons of each module are out of phase with each other in a rotational sense. Ideally they would be out of phase in a balanced way so that if two modules were used they would be 180 degrees out of phase, three modules would be 180 degrees out of phase etc.

It will also be appreciated that the hole 14 in the centre of the main shaft 11 can be used to gain access below or beyond the pump in order to carry out other operations.

The pump is able to operate to achieve high discharge pressures and this is achieved by a number of features. Firstly, the valve 43 and valve seat 44 are honed precision fit surfaces that provide a high pressure seal. Similarly the external surface of the pistons 6 and the internal surface of the piston chamber 8 would be made of a high tolerance honed metal or ceramic finish capable of operating under high pressure. Similarly the wearing surfaces of the helical slot and the rollers followers would be made of wear resistant materials capable of operating under high pressures.

The invention claimed is:

1. A modular pump system for use downhole in a well, having at least a first pump comprising a tube and a cylinder block, the cylinder block defining at least one cylinder with a respective piston inside the cylinder, the movement of the piston in the cylinder causing fluid to be drawn into the first pump through a pump inlet before being pushed out through a pump outlet, the cylinder block being housed in the tube, the tube having a cammed surface formed by an internal wall of the tube, the piston having a cam follower such that rotation of the cylinder block to the tube causes the piston to move relative to the cylinder;

the first pump having two ends, the tube and the cylinder block being connectable at each of the ends in series relation respectively to the corresponding tube and cylinder block of a further said pump such that the tube is rotationally locked to the corresponding tube of the further said pump to form a modular pump assembly.

2. A modular pump system according to claim 1, wherein the pump outlet feeds into a bore which extends through the pump, the bore being connectable at each of the ends to the corresponding bore of a further said pump to form a common manifold.

3. A modular pump system according to claim 2, wherein the tube and the cylinder block are connectable at each of the ends respectively to the corresponding tube and cylinder block of a further said pump in a rotationally oriented position, so that the strokes of the piston or pistons of the first pump are out of step with the strokes of the piston or pistons of the further pump such that the outlet stream is more uniform.

4. A modular pump system according to claim 1, wherein the cammed surface is a groove formed in the internal wall of the tube.

5. A modular pump system according to claim 4, wherein the piston is axially aligned with the tube.

6. A modular pump system according to claim 5, wherein at least a further piston is axially aligned with the tube, the further piston acting as a valve to control a path from the cylinder to the pump inlet or pump outlet.

7. A modular pump system according to claim 1, wherein the cammed surface is an elliptical surface lying in a plane oblique to the tube's axis.

8. A modular pump system according to claim 1, wherein pumping surfaces of the first pump are hard faced and honed to a precision fit.

9. A modular pump system according to claim 2, wherein the bore extends axially centrally through the pump.

10. A modular pump system according to claim 1, wherein the tube includes a respective splined connection means at each of the ends whereby the tube may be connected in series to the corresponding tube of a further said pump.

11. A modular pump system according to claim 10, wherein the cylinder block includes a respective threaded connection means at each of the ends whereby the cylinder block may be connected in series to the corresponding cylinder block of a further said pump.

* * * * *